US008277208B2

(12) United States Patent
Paluszewski et al.

(10) Patent No.: US 8,277,208 B2
(45) Date of Patent: Oct. 2, 2012

(54) SPLIT DISCHARGE VANE PUMP AND FLUID METERING SYSTEM THEREFOR

(75) Inventors: Paul J. Paluszewski, Meriden, CT (US); Mihir C. Desai, Yorba Linda, CA (US); Xingen Dong, Farmington, CT (US)

(73) Assignee: Goodrich Pump & Engine Control Systems, Inc., West Hartford, CT (US)

( * ) Notice: Subject to any disclaimer, the term of this patent is extended or adjusted under 35 U.S.C. 154(b) by 488 days.

(21) Appl. No.: 12/456,086

(22) Filed: Jun. 11, 2009

(65) Prior Publication Data

US 2010/0316507 A1 Dec. 16, 2010

(51) Int. Cl.
*F03C 2/00* (2006.01)
*F03C 4/00* (2006.01)
*F04C 2/00* (2006.01)

(52) U.S. Cl. ..... 418/15; 418/133; 418/148; 418/259; 418/260

(58) Field of Classification Search ..... 418/15, 418/133, 136, 146, 148, 259, 260, 266–268
See application file for complete search history.

(56) References Cited

U.S. PATENT DOCUMENTS

| | | | | | |
|---|---|---|---|---|---|
| 888,838 | A * | 5/1908 | Muller | 418/260 |
| 4,047,859 | A * | 9/1977 | Sundberg | 418/232 |
| 4,274,817 | A | 6/1981 | Sakamaki et al. | |
| 4,408,964 | A * | 10/1983 | Mochizuki et al. | 418/259 |
| 4,516,918 | A * | 5/1985 | Drutchas et al. | 418/15 |
| 4,599,057 | A * | 7/1986 | Baghuis | 418/146 |
| 4,963,080 | A * | 10/1990 | Hansen | 418/260 |
| 5,017,098 | A | 5/1991 | Hansen et al. | |
| 5,064,362 | A | 11/1991 | Hansen | |
| 5,545,018 | A | 8/1996 | Sundberg | |
| 6,527,525 | B2 * | 3/2003 | Kasmer | 418/268 |
| 6,533,556 | B1 | 3/2003 | Cozens et al. | |
| 8,011,909 | B2 * | 9/2011 | Dong | 418/259 |
| 2008/0240935 | A1 | 10/2008 | Dong | |

* cited by examiner

*Primary Examiner* — Theresa Trieu
(74) *Attorney, Agent, or Firm* — Edwards Wildman Palmer LLP; Scott D. Wofsy

(57) ABSTRACT

A split discharge vane pump is disclosed having a pump body that includes an interior pumping chamber having a central axis and defining a continuous peripheral cam surface, the cam surface including four quadrantal cam segments, wherein diametrically opposed cam segments have identical cam profiles, and each cam segment defines an inlet arc, a discharge arc and two seal arcs. A rotor is mounted for axial rotation within the pumping chamber and a plurality of circumferentially spaced apart radially extending vanes are mounted for radial movement within the rotor, wherein the plurality of vanes define an equal number of circumferentially spaced apart buckets which extend between the rotor and the cam surface of the pumping chamber for carrying pressurized fluid.

17 Claims, 11 Drawing Sheets

Fig. 5
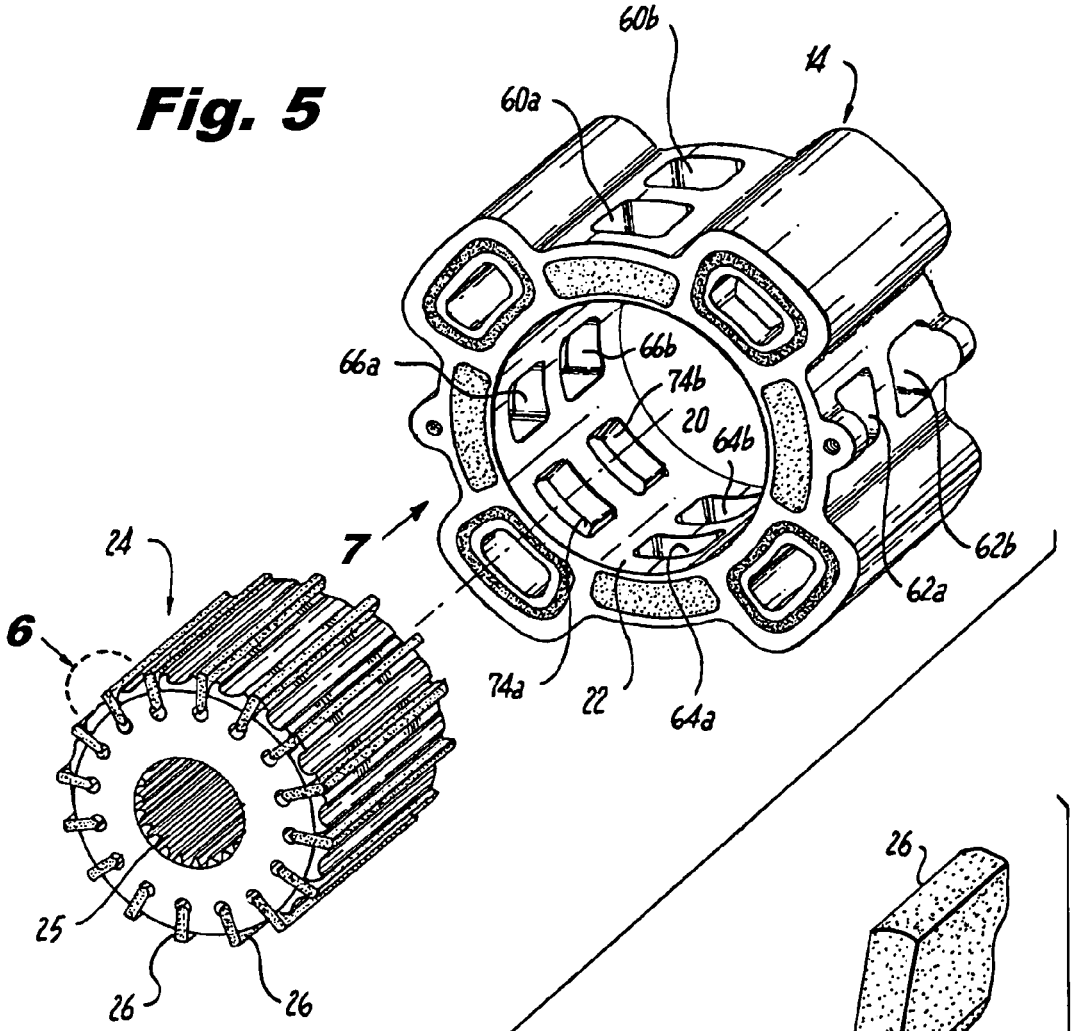
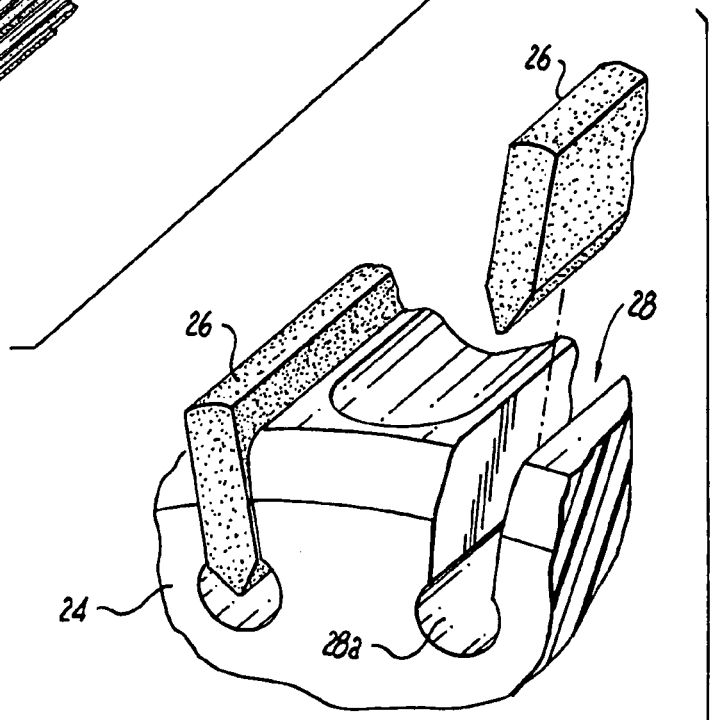
Fig. 6

SPLIT DISCHARGE VANE PUMP AND FLUID METERING SYSTEM THEREFOR

BACKGROUND OF THE INVENTION

1. Field of the Invention

The subject invention is directed to rotary vane pumps, and more particularly, to a balanced split discharge vane pump that provides a first discharge flow for high fluid demand conditions and a second discharge flow for low fluid demand conditions, and to a system for metering fluid flow from a split discharge vane pump depending upon fluid demand conditions.

2. Description of Related Art

Rotary hydraulic vane pumps are well known in the art, as disclosed for example in U.S. Pat. No. 4,274,817 to Sakamaki et al. and U.S. Pat. No. 5,064,363 to Hansen. A typical rotary vane pump includes a circular rotor mounted for rotation within a larger circular pumping chamber. The centers of these two circles are typically offset, causing eccentricity. Vanes are mounted to slide in and out of the rotor to create a plurality of volume chambers or vane buckets that perform the pumping work. On the intake side of the pump, the vane buckets increase in volume. These increasing volume vane buckets are filled with fluid that is forced into the pumping chamber by an inlet pressure. On the discharge side of the pump, the vane buckets decrease in volume, forcing pressurized fluid out of the pumping chamber.

It is desirable to match the fluid displacement of a vane pump to the operating characteristics of the system with which the pump is to be associated. For example, the maximum displacement of a fuel pump should be coordinated with the maximum fuel requirements of the associated engine application. However, system requirements typically vary with operating conditions, so that a fixed displacement fuel pump that is designed as a function of the most demanding engine operating conditions may function with less than desired efficiency under other operating conditions.

In the case of a fuel pump associated with a gas turbine engine of an aircraft, fuel flow requirements, as quantified by pump displacement per rotational speed, under engine starting conditions greatly exceed fuel flow requirements during other less demanding engine operating conditions, such as cruise, idle, decent and taxi. Various attempts have been made to improve fuel pump efficiency over the operating envelope of a gas turbine engine, by utilizing different valving arrangements at the pump outlet to meter a portion of the pump discharge to the engine as a function of engine demand, while recirculating the remainder of the flow back into the pump. However, these prior art arrangements are typically complex and thus add cost to the pumping system. In other implementations, variable displacement pumps have been utilized to match pump output flow to system demand. However, these implementations are at the expense of pump size/weight and reliability because of an increase in pump radial/axial loading and incorporation of additional moving parts.

It would be beneficial therefore to provide a positive displacement vane pump that is adapted and configured to more closely match the operating characteristics of the system with which it is associated, as well as a valving arrangement for effectively managing the flow of fluid from the pump depending upon the fluid demand conditions of the system with which it is associated. This is achieved by retaining the simple features of fixed displacement pumps and hence preserving their weight and reliability advantages.

SUMMARY OF THE INVENTION

The subject invention is directed to a new and useful rotary hydraulic pump, which is well adapted for use as a fuel pump for engine applications, such as, for example, aircraft gas turbine engines. More particularly, the subject invention is directed to a positive displacement rotary vane pump that includes a pump body having an interior pumping chamber with a central axis and a continuous peripheral cam surface. The cam surface includes four quadrantal cam segments, wherein diametrically opposed cam segments have identical cam profiles, and each cam segment defines an inlet arc, a discharge arc and two seal arcs.

A cylindrical rotor is mounted for axial rotation within the pumping chamber and a plurality of circumferentially spaced apart radially extending vanes are mounted for radial movement within the rotor. The vanes define an equal number of circumferentially spaced apart volume chambers or buckets which extend between an outer periphery of the rotor and the cam surface for carrying pressurized fluid.

Preferably, a seal arc separates the inlet arc and discharge arc in each cam segment, and a seal arc separates the inlet arc in one segment from the discharge are in a circumferentially adjacent segment. The discharge arcs of diametrically opposed cam segments are equally sized, whereas the discharge arcs of circumferentially adjacent cam segments are not of equal size. Preferably, there are sixteen circumferentially spaced apart radially extending vanes and an equal number of circumferentially spaced apart volume chambers or buckets for carrying pressurized fluid.

The pump body includes inlet port means communicating with the inlet arc of each cam segment and outlet port means communicating with the discharge arc of each cam segment. In addition, the rotor includes a plurality of circumferentially spaced apart radially extending vane slots for accommodating the plurality of vanes. The pump further includes laterally opposed side plates for enclosing the pumping chamber. Each vane slot has an undervane pocket for receiving pressurized fluid and each side plate includes means for feeding fluid into the undervane pocket of each vane slot based on an angular position of the rotor.

In accordance with an embodiment of the invention, the pressurized fluid in the rotor undervane while it is located in the inlet arc of a cam segment is relatively low pressure fluid associated with an inlet arc of a cam segment, and is equal to pump inlet pressure. Conversely, the pressurized fluid in the rotor undervane while it is located in the discharge arc of a cam segment is relatively high pressure fluid associated with a discharge arc of a cam segment, and is equal to pump discharge pressure. In contrast, the pressurized fluid in the rotor undervane while it is located in a seal arc of a cam segment is relatively high pressure fluid associated with a discharge arc of a cam segment, and is equal to pump discharge pressure.

The split discharge vane pump of the subject invention further includes a fluid metering system for extracting fluid flow from the discharge arcs of the four cam segments. The fluid metering system has a first operating condition in which fluid is extracted from the discharge arcs of all four cam segments and combined for delivery to a source of fluid demand. The fluid metering system has a second operating condition wherein fluid is extracted from a first pair of diametrically opposed discharge arcs for delivery to a source of fluid demand and fluid from a second pair of diametrically opposed discharge arcs bypasses the source of fluid demand and returns to inlet side of the pumping chamber.

The subject invention is also directed to a fluid metering system that includes a balanced positive displacement vane pump having primary and secondary pairs of discharge arcs, wherein the primary pair of discharge arcs is adapted and configured to discharge pressurized fluid from the pump at a first volumetric flow rate and the secondary pair of discharge arcs is adapted and configured to discharge pressurized fluid from the pump at a second volumetric flow rate. The system further includes means for extracting pressurized fluid flow from the primary and secondary pairs of discharge arcs for combined delivery to a source of fluid demand so as to satisfy a first demanded fluid condition, and for extracting pressurized fluid from the primary pair of discharge arcs for delivery to the source of fluid demand while at the same time directing pressurized fluid from the secondary pair of discharge arcs to bypass the source of fluid demand so as to satisfy a second demanded fluid condition. It is envisioned and well within the scope subject disclosure that any fluid demand condition can be satisfied by an appropriate combination of the primary and secondary flows, since each can be modulated by the subject fluid metering system.

The means includes a regulator valve for controlling the extraction of pressurized fluid from one or both pairs of discharge arcs depending upon the demanded fluid condition. The means further includes a bypass valve, the opening of which is controlled by the regulator valve, for causing fluid from the secondary pair of discharge arcs to bypass the source of fluid demand and return to the inlet side of the pump in response to the second demanded fluid condition. The means further includes a check valve in communication with the source of fluid demand and having a normally closed position corresponding to the second demanded fluid condition wherein fluid from the primary pair of discharge arcs is permitted to flow to the source of fluid demand and an open position corresponding to the first demanded fluid condition wherein fluid from the primary and secondary pairs of discharge arcs is permitted to flow to the source of fluid demand.

The fluid metering system further comprises external control means for controlling the regulator valve. The external control means can take the form of a dual channel torque motor, an electro-hydraulic servo valve or a similar control device known in the art. The external controller would be in communication with and receive commands from a Full-Authority Digital Controller (FADEC).

In another embodiment of the subject invention, the split discharge vane pump is operatively associated with separate fluid metering systems that function independently to extract fluid flow from the respective discharge arcs of the four cam segments. The system has an alternative operating condition (with alternative control schema) in which high pressure fluid is extracted from the discharge arcs of each pair of diametrically opposed cam segments and ported to separate loads (i.e., the flow is not combined). Each pump pair is controlled and plumbed independently at different operating pressures. Alternatively, fluid flow from one or both pairs of diametrically opposed cam segments is bypassed to inlet pressure.

These and other features of the split discharge vane pump and fuel metering system of the subject invention will become more readily apparent to those having ordinary skill in the art from the following detailed description of the invention taken in conjunction with the several drawings described below.

BRIEF DESCRIPTION OF THE DRAWINGS

So that those skilled in the art to which the subject invention appertains will readily understand how to make and use the split discharge vane pump of the subject invention without undue experimentation, preferred embodiments thereof will be described in detail below with reference to certain figures, wherein:

FIG. 5 is an exploded perspective view of the pump body with the pump rotor removed from the pumping chamber;

FIG. 6 is an enlarged localized view of a section of the pump rotor illustrating one of the sixteen circumferentially spaced apart radially extending vanes supported within a vane slot that includes an undervane pocket and an adjacent vane removed from its vane slot for ease of illustration;

DESCRIPTION OF THE PREFERRED EMBODIMENTS

Figure 1:
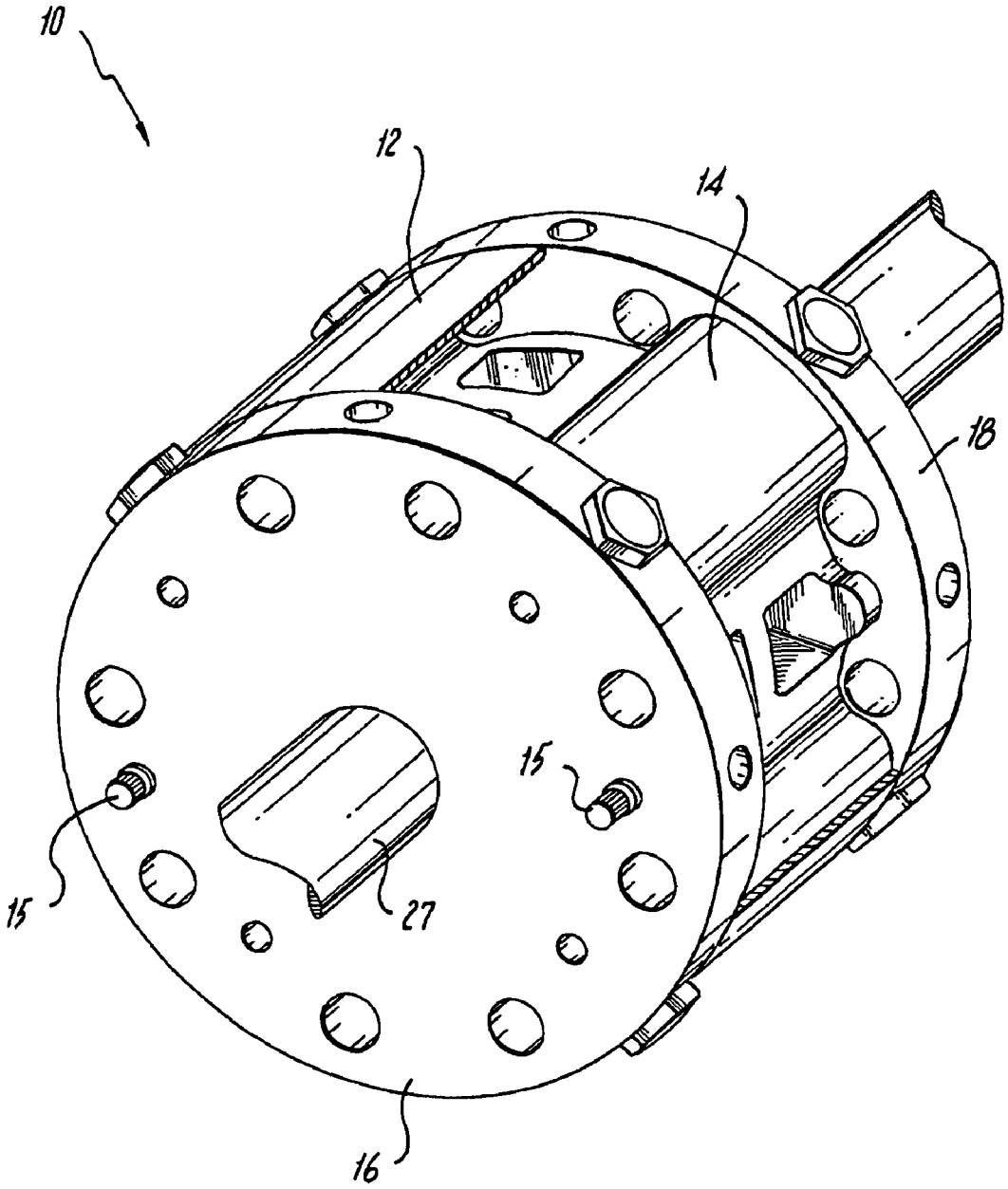
FIG. 1 is a perspective view of a split discharge vane pump constructed in accordance with a preferred embodiment of the subject invention, with a portion of the pump casing or housing removed to illustrate features of the pump body.

Referring now to the drawings wherein like reference numerals identify similar structural features or elements of the subject invention, there is illustrated in FIG. 1 a split discharge vane pump constructed in accordance with a preferred embodiment of the subject invention and designated generally by reference numeral 10. As discussed in more detail below, vane pump 10 is a balanced positive displacement vane pump that has two distinctly sized sets or pairs of discharge arcs. In particular, the pump has a first or primary pair of discharge arcs that are sized to discharge fluid from the pump at a first volumetric rate (e.g., 35 gpm) and a second or secondary pair of discharge arcs that are sized to discharge fluid from the pump at a second volumetric rate (e.g., 30 gpm).

Vane pump 10 is preferably associated with a fluid metering or distribution system that is adapted and configured to control or otherwise regulate the flow of fluid discharged from the pump during operation. In accordance with one embodiment of the subject invention, this fluid metering system has a first operating condition in which fluid from the primary and secondary discharge arc pairs is conveyed to a source of fluid demand at a combined volumetric flow rate (e.g., 65 gpm). The fluid metering system has a second operating condition in which fluid from the primary pair of discharge arcs is conveyed to the source of fluid demand, while fluid discharged from the secondary pair of discharge arcs is caused to bypass the source of fluid demand and return to the pump. Bypassing a portion of the pump's discharge capacity back to the inlet side of the pump serves to reduce the input power consumption of the and thereby improve overall system thermal efficiency.

It is envisioned that the vane pump of the subject invention can be employed as a positive displacement fuel pump and the fluid metering system can be configured as a fuel metering system associated with an aircraft gas turbine engine. In such a configuration, the first system operating condition would correspond to high fuel flow conditions such as engine start-up and the second system operating condition would correspond to low fuel flow conditions such as idle, cruise, decent or taxi. Thus, the discharge arc pairs of the vane pump 10 of the subject invention can be sized to a specific mission profile for an aircraft so as to optimize thermal efficiency across an entire engine operating envelope.

Referring now to FIG. 1, the vane pump 10 of the subject invention is configured as a cartridge adapted for containment within a sealed enclosure or casing 12. Vane pump 10 includes a main pump body 14, a front face plate 16 and a rear face plate 18. The front and rear face plates 16 and 18 are secured to the front and rear surfaces of pump body 14 with a plurality of threaded fasteners 15 or the like.

Figure 2:
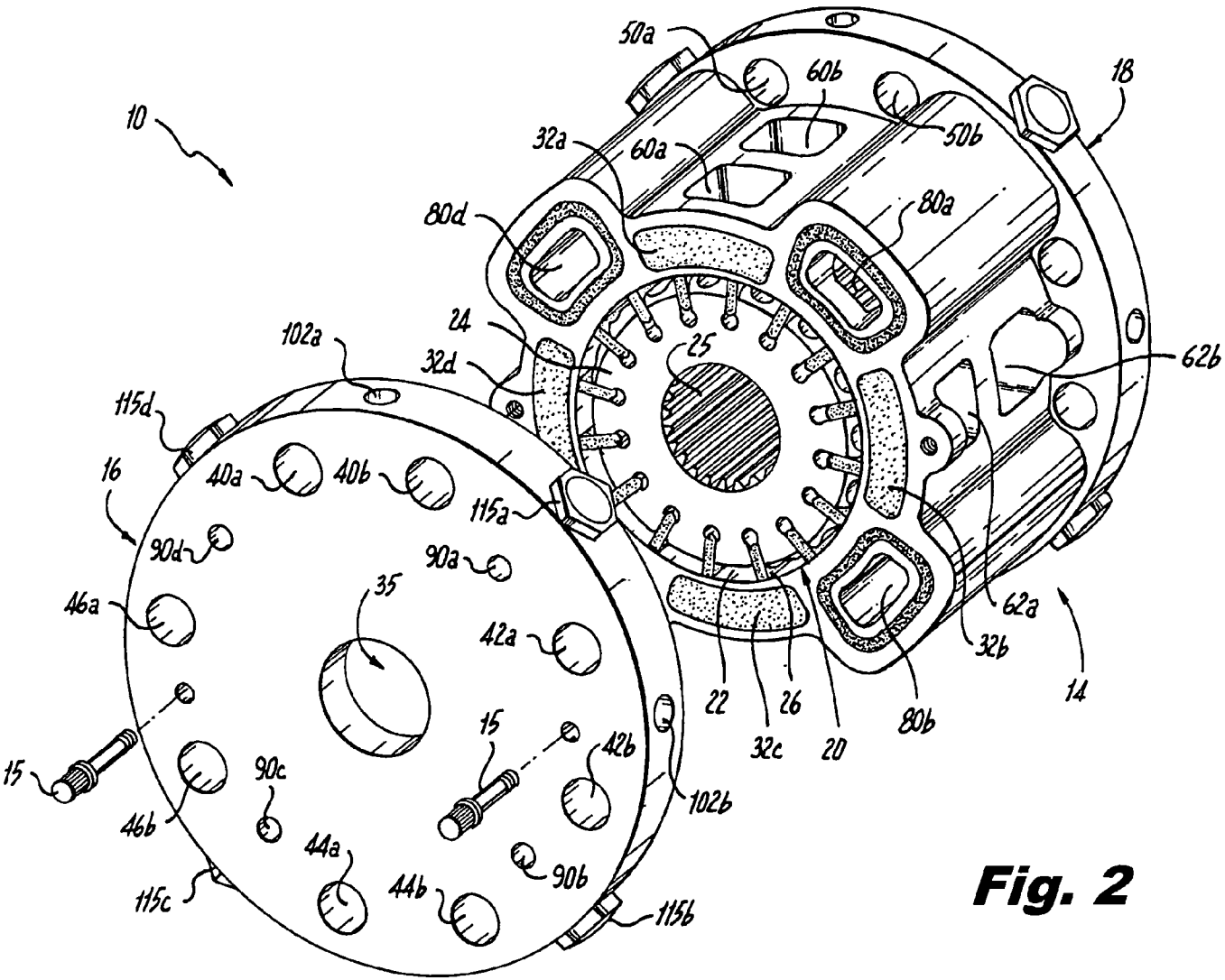
FIG. 2 is a perspective view of the split discharge vane pump of shown in FIG. 1, with the casing removed and the front face plate removed to illustrate the rotor within the pumping chamber of the pump body.
Figure 7:
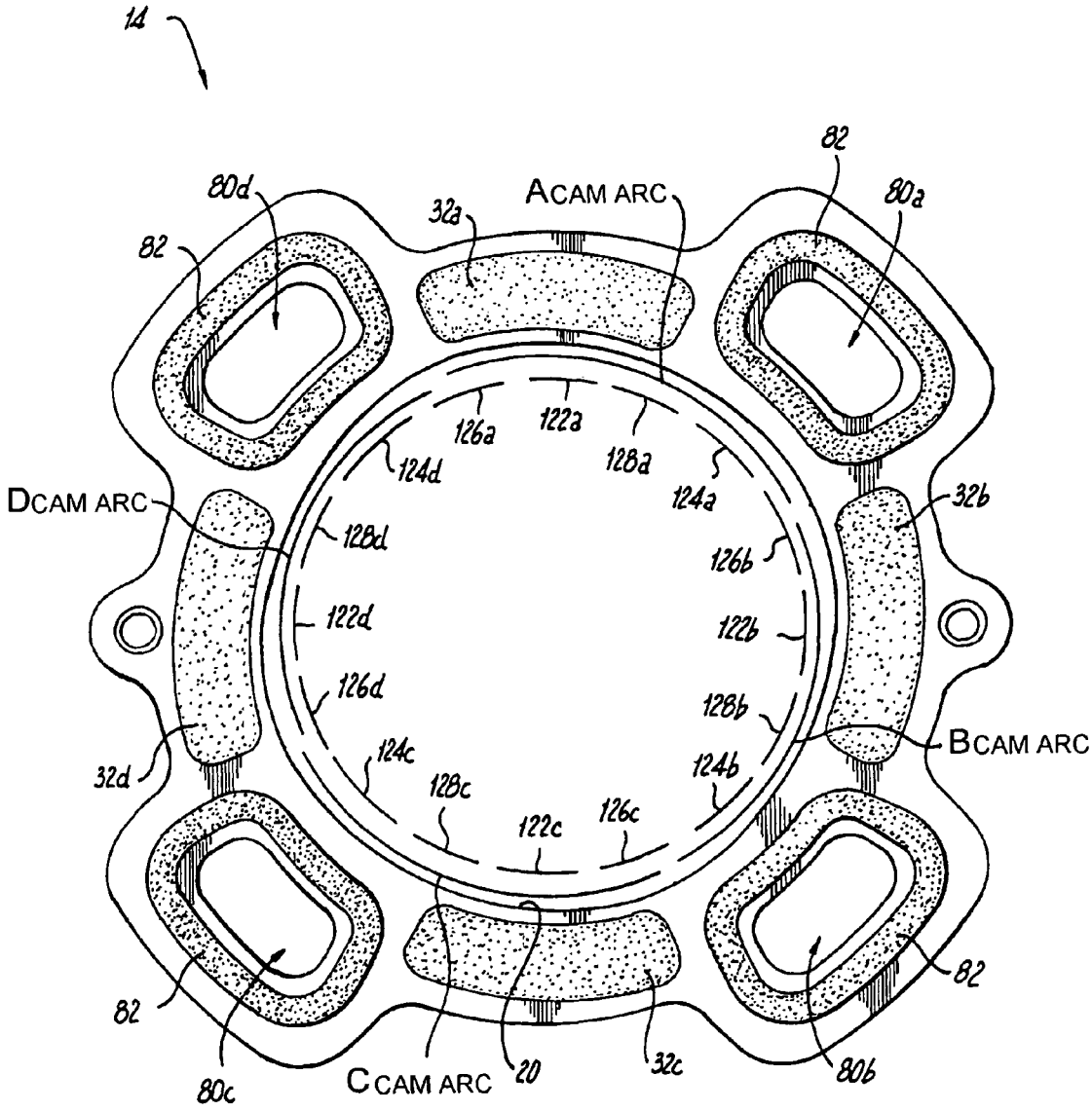
FIG. 7 is a front elevational view of the pump body as shown in FIG. 5, illustrating the contour of the cam surface of the pumping chamber, which includes four quadrantal cam segments, each having an inlet arc, a discharge arc and two seal arcs.

Referring to FIG. 2, the front and rear face plates 16 and 18 enclose the interior pumping chamber 20 of pump body 14. As best seen in FIGS. 5 and 7, the pumping chamber 20 defines a central axis and a continuous peripheral cam surface 22. The configuration or profile of the cam surface 22 establishes the differential sizing of the primary and secondary discharge arc pairs described above, which will be described in far greater detail below with respect to FIG. 7.

Figure 8:
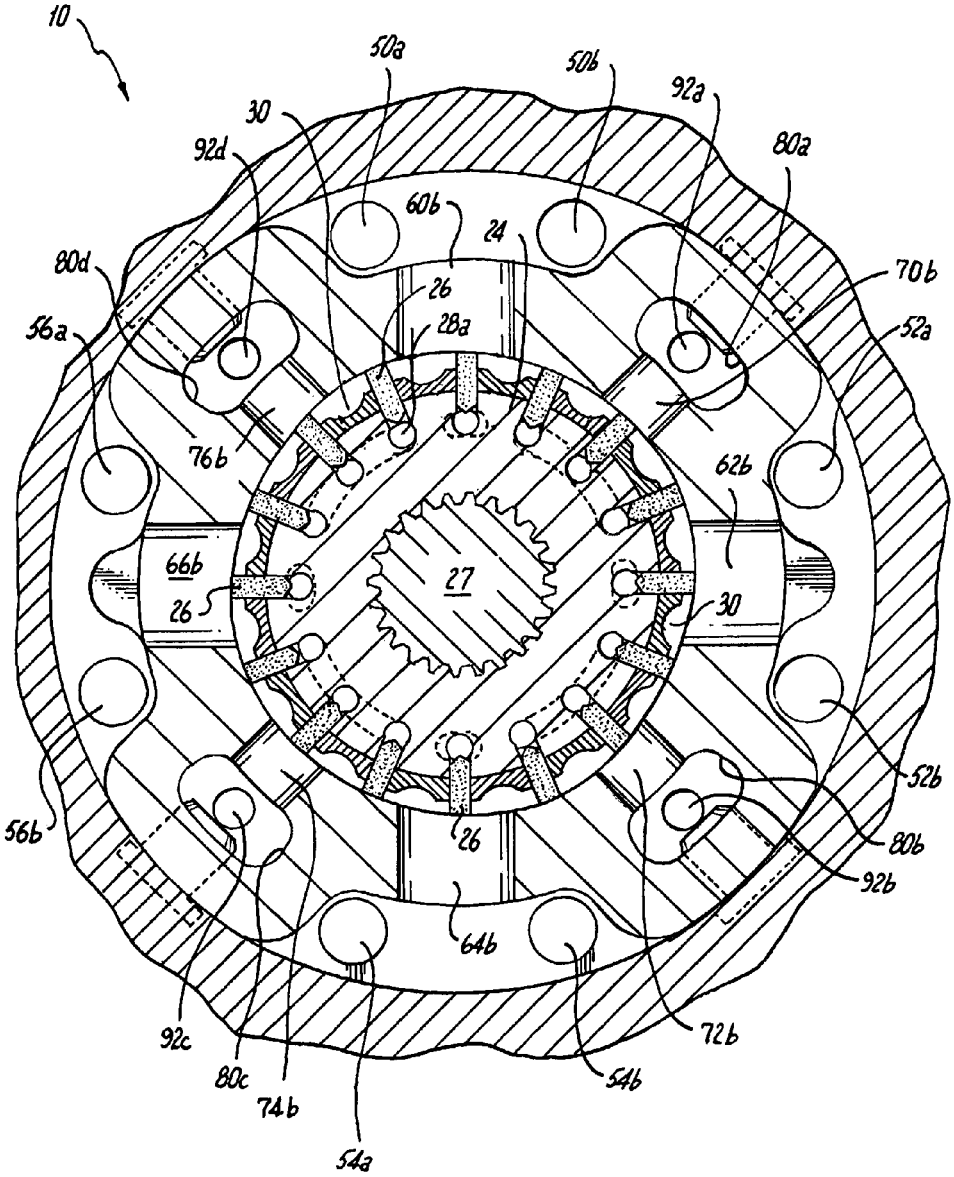
FIG. 8 is a cross sectional view of the split discharge vane pump of the subject invention, taken along line 8-8 of FIG. 3, illustrating the interior features of the pump housing and rotor.

Referring to FIGS. 5 and 8, a cylindrical rotor 24 is mounted for axial rotation within the pumping chamber 20 of pump body 14. The rotor 24 has a central bore 25 for receiving a splined drive shaft 27, best seen in FIG. 1. Drive shaft 27 is driven by a prime mover associated with the pump, such as a gas turbine engine. A plurality of circumferentially spaced apart radially extending vanes 26 are mounted for radial movement within a corresponding number of circumferentially spaced apart radial vanes slots 28 formed in rotor 24. As best seen in FIG. 6, each vane slot 28 has an undervane pocket 28*a* for receiving pressurized fluid to balance the inwardly directed hydraulic forces exerted at the overvane as the vanes 26 track along the cam surface 22 of pumping chamber 20, as discussed in greater detail below. Preferably, vane pump 10 has an even number of vanes/slots and more preferably vane pump 10 includes sixteen radially extending vanes 26. The vanes 26 define an equal number of circumferentially spaced apart pumping buckets or volume chambers 30 which extend between the outer peripheral surface of rotor 24 and the cam surface 22 of pumping chamber 20.

As explained in more detail below with respect to FIGS. 7 and 10, each bucket 30 receives low pressure fluid delivered into the pumping chamber 20 of pump body 14 as it travels through an inlet arc of the cam surface 22. Conversely, each bucket 30 discharges fluid at a higher pressure as it travels through a discharge arc of the cam surface 22. As each bucket 30 travels from an inlet arc to a discharge arc, it travels through a seal arc of the cam surface 22, wherein the volume of the bucket is reduced and the fluid is discharged from the bucket due to the contracting bucket volume.

Figure 3:
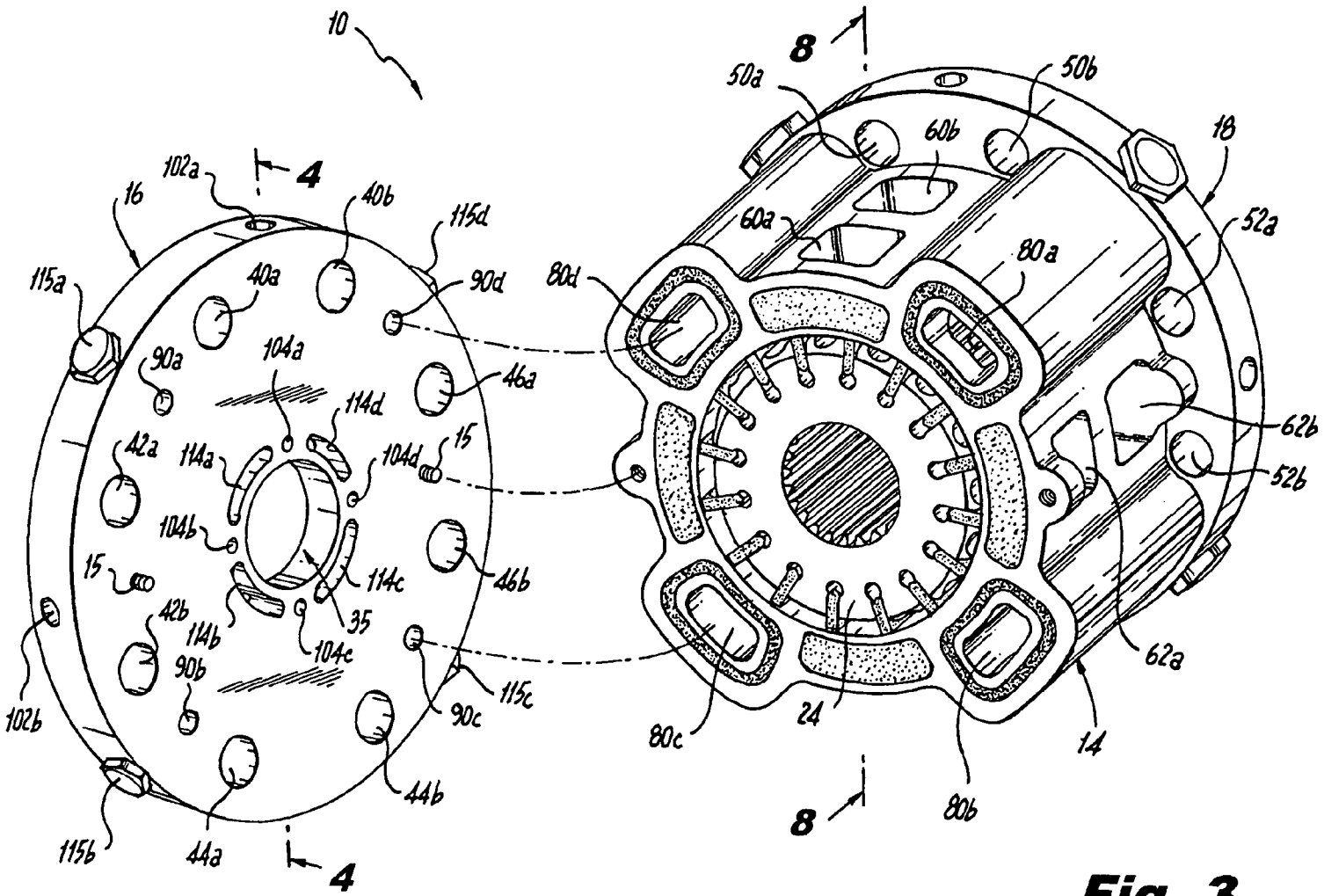
FIG. 3 is a perspective view of the split discharge vane pump as shown in FIG. 2, with the front face plate rotated 90° to illustrate the interior surfaces features thereof, including the undervane feed slots and undervane feed ports.

Referring to FIGS. 2 and 3, a plurality of circumferentially spaced apart arcuately-shaped magnets 32*a*-32*d* surround the pumping chamber 20 of pump body 14. These magnets attract the metallic vanes 26 mounted in rotor 24 and ensure that the radially outer tips of the vanes remain in constant contact with the continuous cam surface 22 of pumping chamber 20 during pump operation. This inhibits leakage between adjacent buckets 30 as the vanes 26 track along the cam surface 22.

Figure 9:
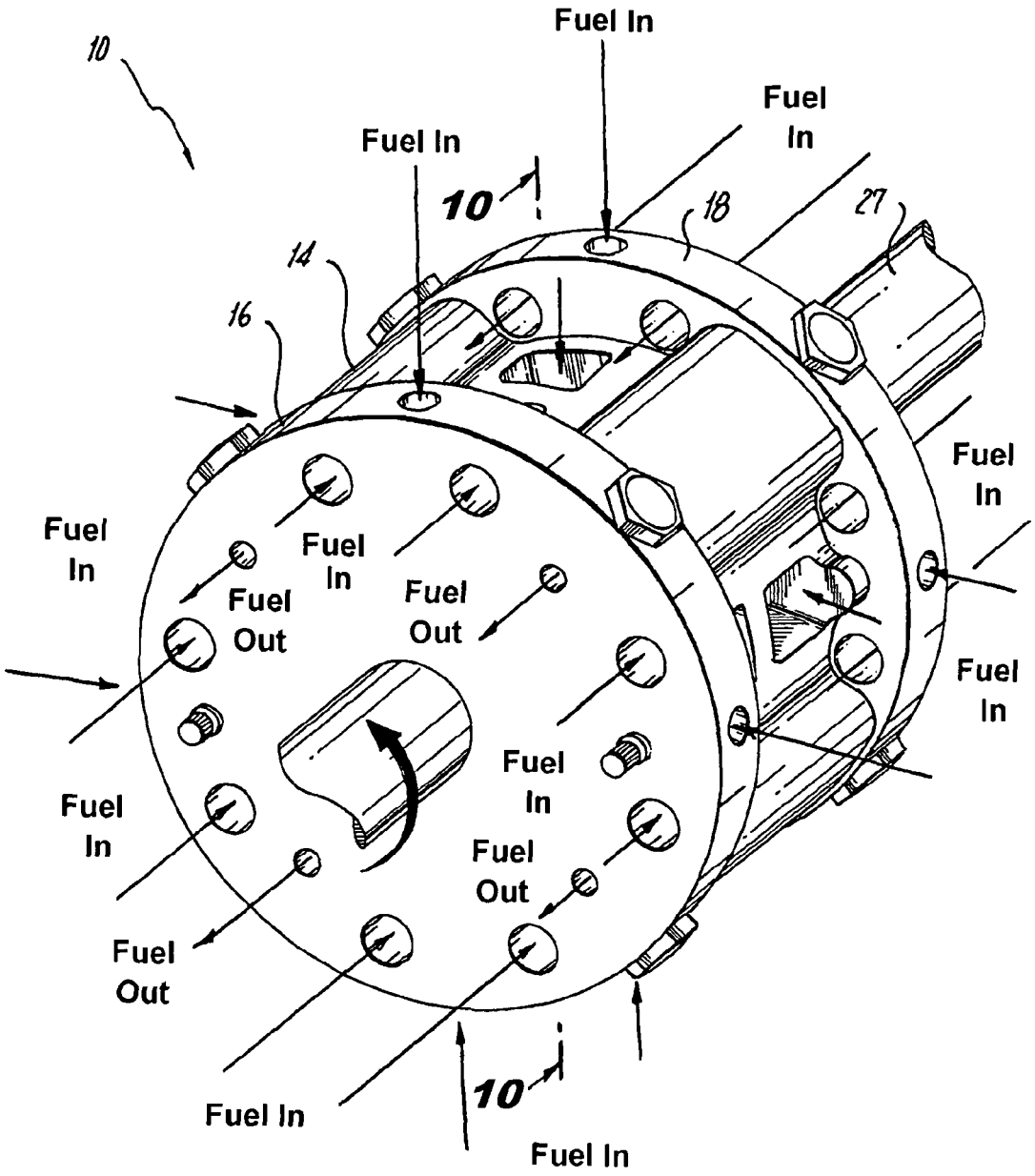
FIG. 9 is a perspective view of the split discharge vane pump shown in FIG. 1, illustrating the directional flow lines of fuel admitted into and discharged from the pump body and side plates during operation.

Referring to FIGS. 2 through 5 in conjunction with FIG. 9, the front and rear face plates 16 and 18 of vane pump 10 each defines a central bore 35 for accommodating passage of the drive shaft 27. In addition, each face plate defines a plurality of inlet ports that deliver low pressure fluid to a group of intake portals formed in the pump body 14, which communicate directly with the interior pumping chamber 20. More particularly, the front face plate 16 defines the upper inlet port pair 40*a*, 40*a*, right inlet port pair 42*a*, 42*b*, lower inlet port 44*a*, 44*b* and left inlet port pair 46*a*, 46*b*. Corresponding inlet port pairs are also provided in rear face plate 18, including the upper inlet port pair 50*a*, 50*b* and right inlet port pair 52*a*, 52*b*, lower inlet port pair 54*a*, 54*b* and left inlet port pair 56*a*, 56*b*, which are illustrated in FIG. 8. The intake portals in pump body 14 that receive fluid from the inlet port pairs of the front and rear side plates 16 and 18 include two upper intake portals 60*a*, 60*b*, two right intake portals 62*a*, 62*b*, two lower intake portals 64*a*, 64*b*, and two left intake portals 66*a*, 66*b*, which are best seen in FIG. 5.

The pump body 14 further includes a group of discharge portals for directing relatively high pressure fluid from the pumping chamber 20 to a source of fluid demand, such as a gas turbine engine. One pair of discharge portals 74*a*, 74*b* is illustrated in FIG. 5, located between intake portals 64*a*, 64*b* and intake portals 66*a*, 66*b*. Discharge portals 70*b*, 72*b*, 74*b* and 76*b* are also shown in FIG. 8. Each pair of discharge portals in pump body 14 communicate directly with a respective discharge chambers 80*a*-80*d*. Discharge chambers 80*a*-80*d* have front and rear outlets, each surrounded by an elastomeric seal or gasket 82, that communicate with corresponding outlet ports in the front and rear face plates 16 and 18. In this regard, front face plate 16 includes four circumferentially spaced apart outlet ports 90*a*-90*d* that communicate with the discharge chambers 80*a*-80*d*, respectively. A corresponding set of outlet ports 92*a*-92*d* are provided in rear face plate 18, as shown for example in FIG. 8.

Figure 4:
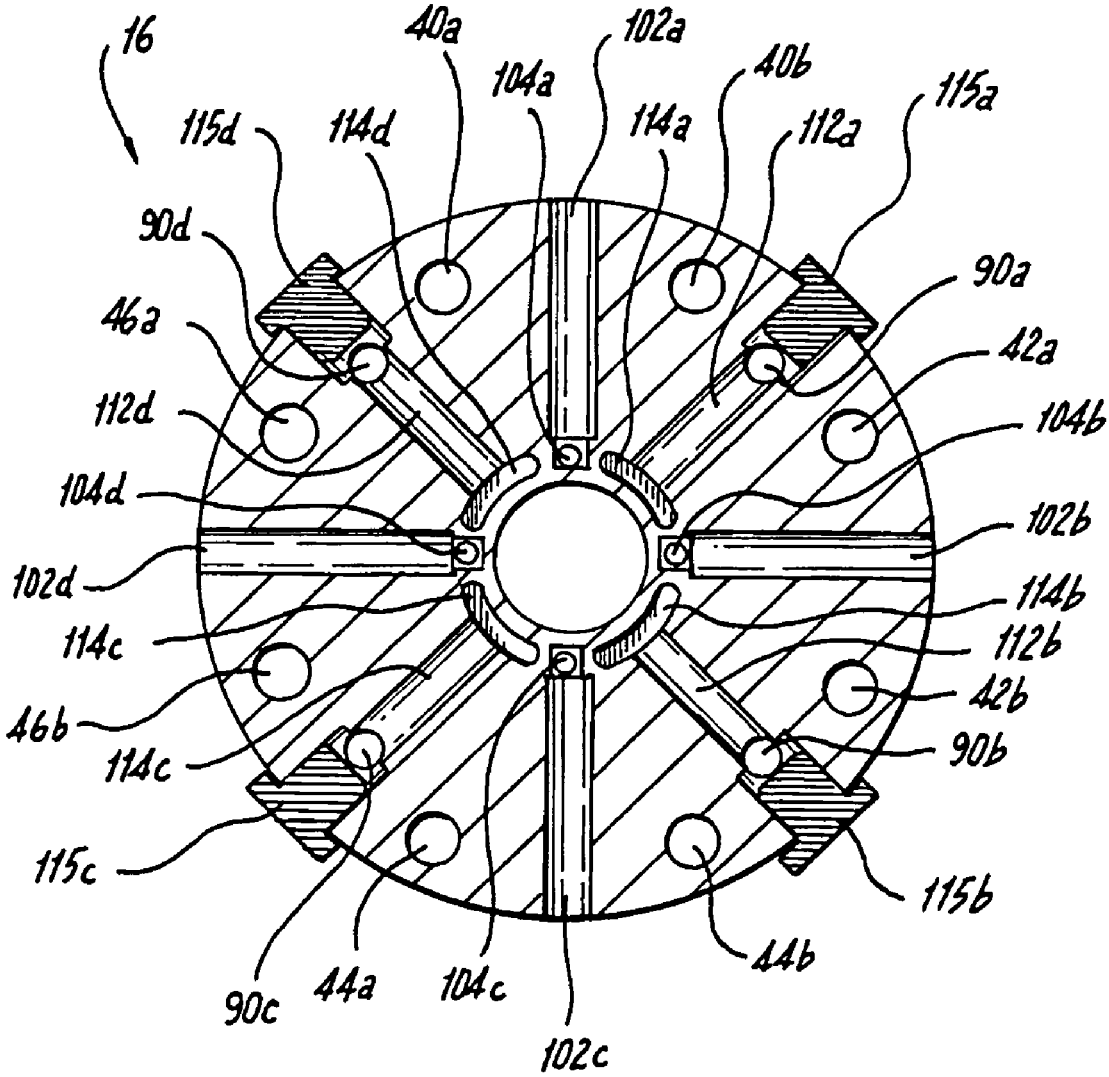
FIG. 4 is a cross-sectional view of the front face plate taken along line 4-4 of FIG. 3, illustrating the undervane feed slots and undervane feed ports, as well as the radial fluid conduits that direct fluid thereto.

Referring to FIGS. 3 and 4, the front and rear face plates 16 and 18 each have four circumferentially spaced apart radially extending low pressure fluid conduits. By way of example, front side plate 16 includes radial fluid conduits 102*a*-102*d*. These conduits direct low pressure fluid to respective feed ports 104*a*-104*d* formed in the interior surface of face plate 16. Feed ports 104*a*-104*d* are aligned with and feed low pressure fluid to the undervane regions or pockets 28*a* of the vane slots 28 in rotor 24, as shown for example in FIG. 8. This low pressure fluid provides a balancing pressure below the vanes 26 as they translate radially within the vane slots 28 in regions of low inlet pressure, such as the inlet arcs of cam surface 22.

With continuing reference to FIGS. 3 and 4, the front and rear face plates 16 and 18 also each include four circumferentially spaced apart radially extending high pressure fluid conduits. By way of example, front side plate 16 includes radial fluid conduits 112*a*-112*d*. These conduits, which are enclosed by threaded end caps 115*a*-115*d*, direct high pressure fluid to respective arcuate feed slot 114*a*-114*d* formed on the interior surface of side plate 16. Feed slots 114*a*-114*d* are aligned with and feed high pressure fluid to a set of undervane pockets 28*a* of the vane slots 28 in rotor 24, as shown for example in FIG. 8. This high pressure fuel provides a balancing pressure below the vanes 26 as they translate within the vane slots 28 in regions of high discharge pressure, such as the outlet arcs of cam surface 22.

It is envisioned that the symmetric face plates 16 and 18 of vane pump 10 can be machined, cast or formed by laminating plural plate layers to one another to form the undervane fluid feed passages, ports and slots formed therein. Furthermore, the direct undervane porting through the symmetric fluid conduits of the front and rear face plates 16 and 18 serves to improve vane tracking, reduce the possibility of undervane cavitation that can reduce pump efficiency, and eliminate the parasitic flow losses associated with communicating an intermediate fluid pressure to the undervane pockets, as is often the case in prior art vane pumps employing undervane porting.

Referring now to FIG. 7, there is illustrated the cross-sectional profile of the continuous cam surface 22 of the pumping chamber 20 of pump body 14. The cam profile is configured to promote constant acceleration and minimize inertial forces exerted on the vane tips for improved cam tracking at low rotor speeds. As mentioned briefly above, cam surface 22 includes four quadrantal cam segments (i.e., cam segment A-D). In accordance with a preferred embodiments of the subject invention, diametrically opposed cam segments have identical or otherwise symmetrical cam profiles. More particularly, cam segments A and C have identical cam profiles, while cam segments B and D have identical cam profiles.

In addition, each of the four cam segments A-D defines an inlet arc section 122 in which low pressure fluid is received with a pumping bucket 30, a discharge arc section 124 in which fluid is discharged from a pumping bucket 30 at a relatively higher pressure, and two seal arcs sections 126, 128 which fluidly isolate the pumping buckets 30 as they translate from an inlet arc to a discharge arc. Thus, cam segment A includes inlet arc section 122*a*, discharge arc section 124*a* and seal arc sections 126*a*, 128*a*; cam segment B includes inlet arc section 122*b*, discharge arc section 124*b* and seal arc sections 126*b*, 128*b*; cam segment C includes inlet arc section 122*c*, discharge arc section 124*c* and seal arc sections 126*c*, 128*c*; and cam segment D includes inlet arc section 122*d*, discharge arc section 124*d* and seal arc sections 126*d*, 128*d*.

In accordance with the subject invention, a seal arc 126 separates the inlet arc 122 and discharge arc 124 in each cam segment A-D. A seal arc 128 also separates the inlet arc 122 in one segment from the discharge arc 124 in a circumferentially adjacent segment. Furthermore, the inlet arcs 122*a* and 122*c* of diametrically opposed cam segments A and C are equally sized, while the inlet arcs 122*a* and 122*b* of circumferentially adjacent cam segments A and B are unequal in size. For example, in an embodiment of the subject invention, diametrically opposed inlet arcs 122*a* and 122*c* may be sized and configured as primary inlet arcs that receive fluid from the pump at a volumetric rate of 35 gpm, whereas diametrically opposed inlet arcs 122*b* and 122*d* may be sized and configured as secondary inlet arcs that receive fluid from the pump at a relatively lower volumetric rate of 30 gpm.

Figure 10:
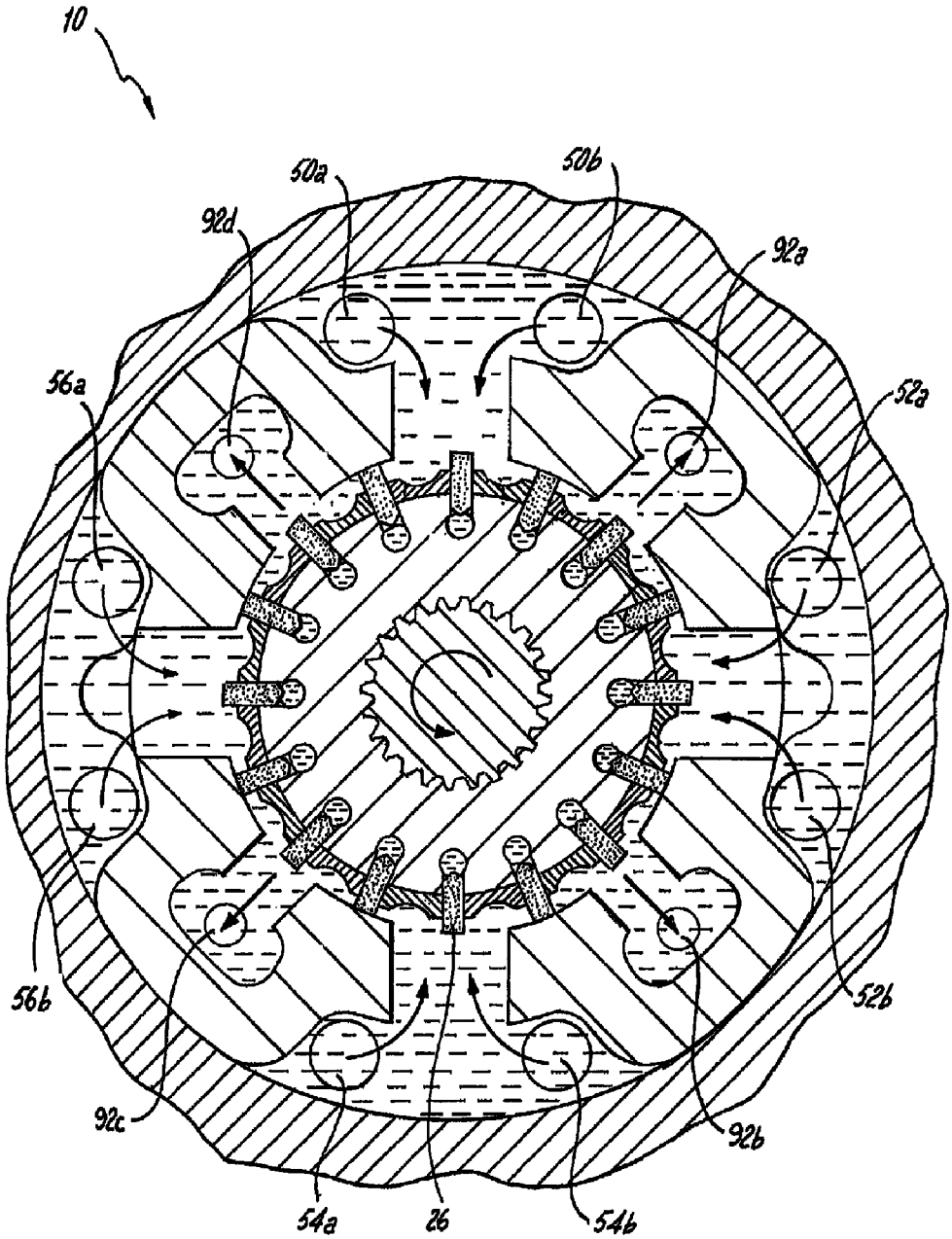
FIG. 10 is a cross-sectional view taken along line 10-10 of FIG. 9, illustrating the directional flow of fuel within the pumping chamber during operation, as the rotor travels in a counter-clockwise direction within the pumping chamber.

Referring now to FIGS. 9 and 10, during operation of the pump 10, axial rotation of drive shaft 27 in a counter-clockwise direction causes corresponding axial rotation of rotor 24 within the pumping chamber 20 of pump body 14. As the rotor 14 turns, low pressure fluid is delivered into the pumping chamber 22 through intake portals 60*a,b*-66*a,b*. The low pressure fluid fills the buckets 30 defined by circumferentially adjacent vanes 28 as they translate through the inlet arcs 122*a*-122*d* of cam segments A-D. As each bucket 30 travels from an inlet arc 122*a*-122*d* to a discharge arc 124*a*-124*d*, it travels through a seal arc 126*a*-126*d*, wherein the volume of the bucket 30 is reduced and the fluid within the bucket is compressed, thus increasing its pressure for discharge. The higher pressure fluid is discharged from pumping chamber 20 into the four discharge chambers 80*a*-80*d* associated with discharge arcs 124*a*-124*d*. After the high pressure fluid is discharged from buckets 30 within the discharge arcs 124*a*-124*d* of cam segments A-D, the buckets 30 travel through seal arcs 128*a*-128*d* of cam segments A-D to the inlet arcs 122*a*-122*d* of cam segments A-D to receive a low pressure fluid once again.

As this pumping action is taking place, the undervane pockets 28*a* of vane slots 28 receive low pressure fluid the low pressure feed ports 104*a*-104*d* in face plates 16 and 18, and the undervane pockets 28*a* of vane slots 28 receive high pressure fluid from arcuate feed slots 114*a*-114*d* in face plates 16 and 18, depending upon an angular position of the rotor 24. More particularly, the pressurized fluid in the rotor undervane pockets 28*a* while they are located in the inlet arc sections 122*a*-122*d* of cam segments A-D is relatively low pressure fluid associated with an inlet arc of a cam segment and is equal to pump inlet pressure. Conversely, the pressurized fluid in the rotor undervane pockets 28*a* while they are located in the discharge arc section 124*a*-124*d* of cam segments A-D is relatively high pressure fluid associated with a discharge arc of a cam segment, and is equal to pump discharge pressure. In contrast, the pressurized fluid in the rotor undervane pockets 28*a* while they are in a seal arc section 126*a*-126*d* or 128*a*-128 of cam segments A-D is relatively high pressure fluid associated with a discharge arc of a cam segment, and is also equal to pump discharge pressure. This undervane porting provides a balancing pressure below the vanes 26 to improve vane tip tracking along cam surface 22.

Figure 11:
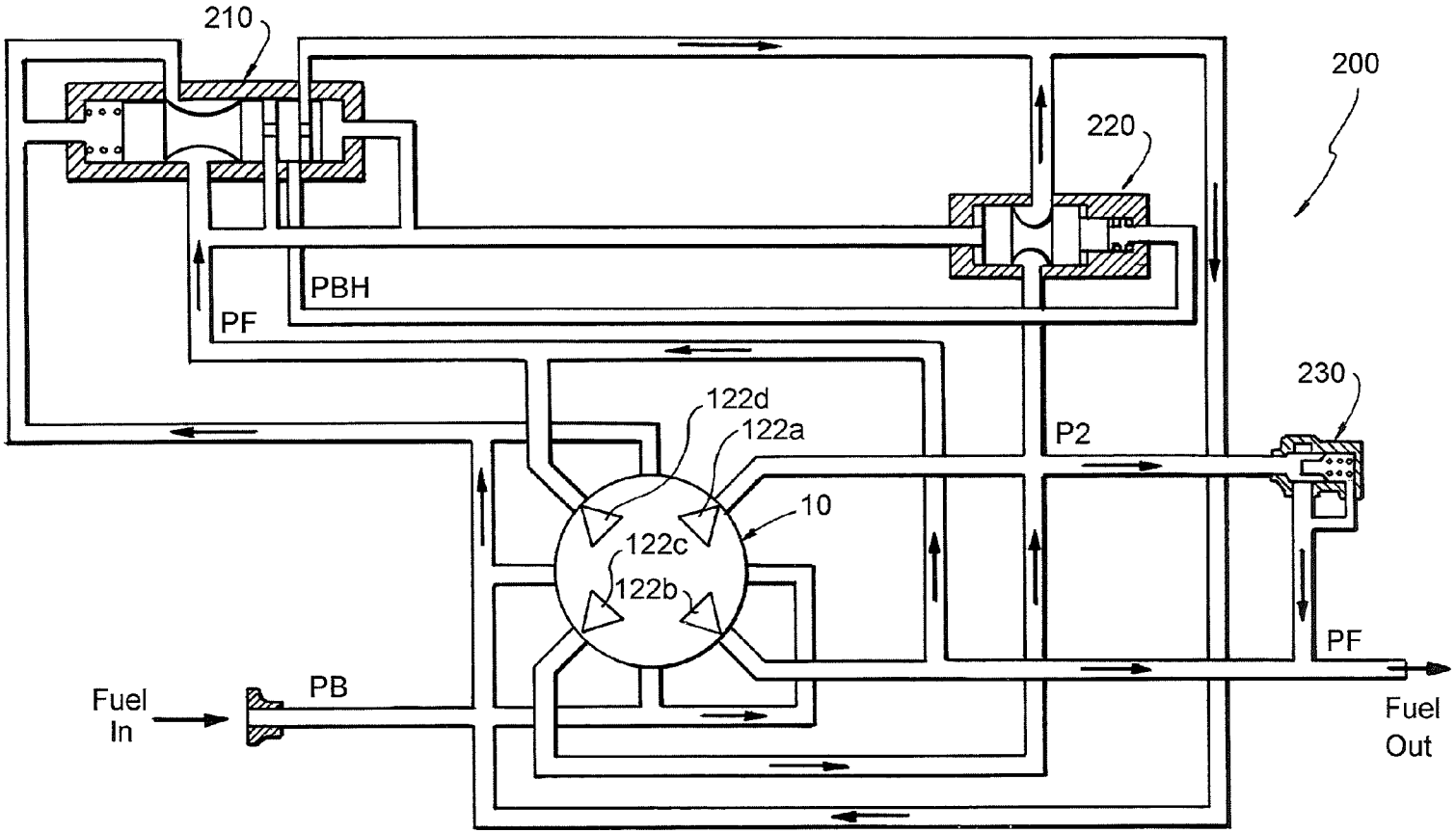
FIG. 11 is a schematic view of an embodiment of a fuel metering system employing the split discharge vane pump of the subject invention, which includes a valve arrangement for managing the extraction of fluid from the primary and second discharge arc pairs of the pump, depending upon fluid demand conditions.

Turning now to FIG. 11, there is illustrated a fuel metering system constructed in accordance with an embodiment of the subject invention and designated generally by reference numeral 200. Fuel metering system 200 includes a split discharge vane pump 10 as described hereinabove which includes a primary pair of diametrically opposed discharge arcs 122*a*, 122*c* that are sized and configured to discharge fluid from the pump at a first volumetric flow rate (e.g., 35 gpm) and a secondary pair of diametrically opposed discharge arcs 122*b*, 122*d* that are sized and configured to discharge fluid from the pump at a second volumetric flow rate (e.g., 30 gpm).

Vane pump 10 receives fluid from a low pressure source at pump inlet pressure PB. Vane pump discharges fluid from the primary pair or discharge arcs 122*a*, 122*c* at a primary discharge pressure PF, and it discharges fluid from the secondary pair of discharge arcs 122*b*, 122*d* at a secondary discharge pressure P2.

Fluid metering system 200 further includes a regulator valve 210 in the form of a spool valve or the like which is adapted and configured to control the extraction of pressurized fluid from one or both pairs discharge arcs depending upon the demanded fluid flow condition. More particularly, regulator valve 210 is configured to extract high pressure discharge flow from both the primary pair of discharge arcs 122*a*, 122*c* and from the secondary pairs of discharge arcs 122*b*, 122*d* under a first demanded fluid flow condition (e.g., at engine start-up) and it is configured to extract high pressure discharge flow from only the primary pair of discharge arcs 122*a*, 122*c* under a second demanded fluid flow condition (e.g., at engine idle).

Fluid metering system 200 also includes a bypass valve 220 which causes high pressure discharge flow from the secondary pair of discharge arcs 122*b*, 122*d* to bypass the source of fluid demand (e.g., a gas turbine engine) and return to the inlet or low pressure side of the pump when regulator valve 210 is operating under the second demanded fluid flow condition. Bypass valve 220 and regulator valve 210 communicate with one another through a sensing line that reports the bypass head pressure PBH acting on the valve.

Fluid metering system 200 also includes a check valve 230 in communication with the source of fluid demand. Check valve 230 has a normally closed position that corresponds to the second demanded fluid flow condition wherein fluid from the primary pair of discharge arcs 122*a*, 122*c* is permitted to flow to the source of fluid demand. Conversely, check valve 230 has open or actuated position that corresponds to the first demanded fluid flow condition wherein fluid from the primary pair of discharge arcs 122*a*, 122*c* and the secondary pair of discharge arcs 122*b*, 122*d* is permitted to flow to the source of fluid demand in an additive or cumulative manner.

Figure 12:
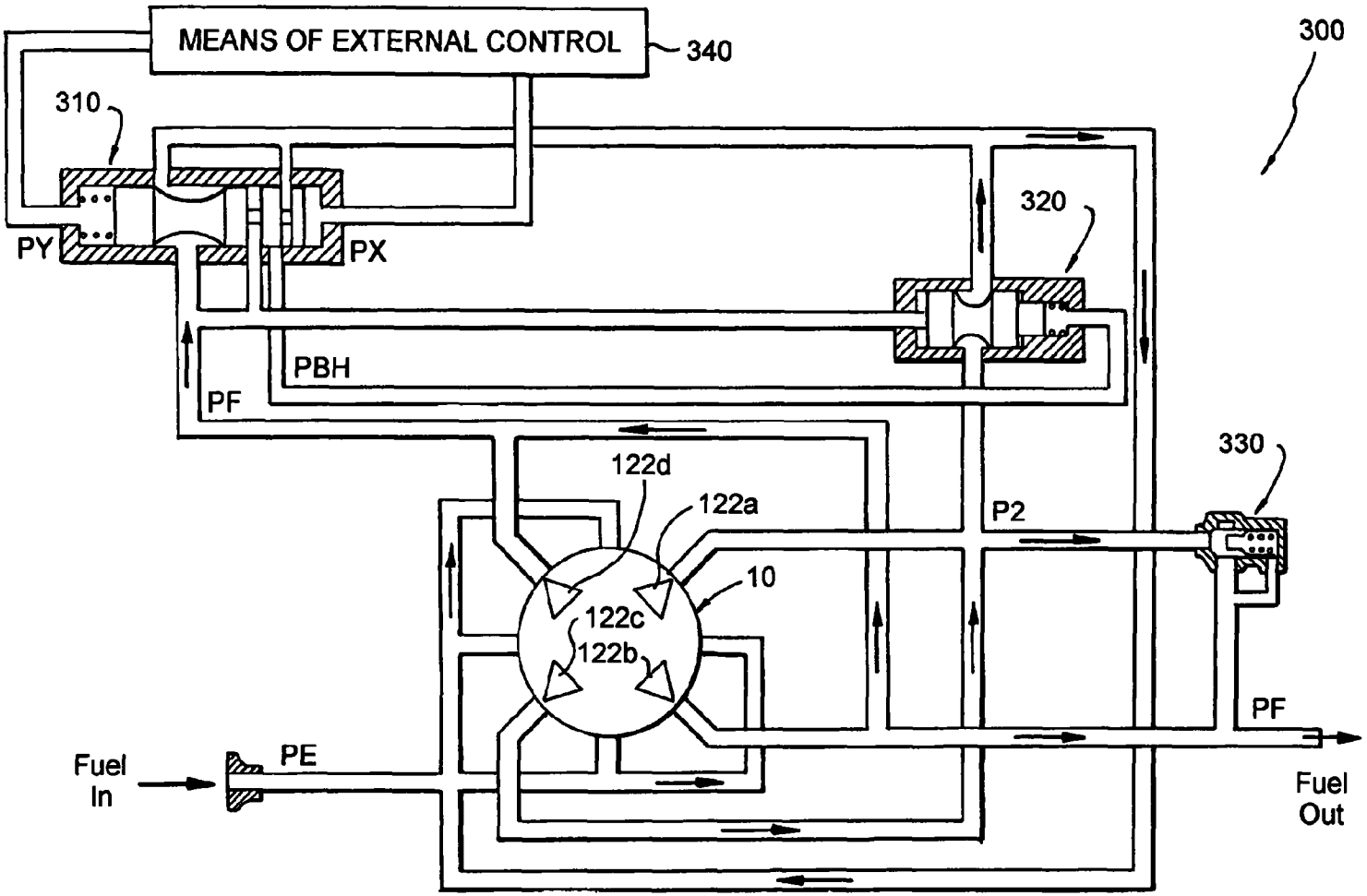
FIG. 12 is a schematic view of another embodiment of a fuel metering system similar to that which is shown in FIG. 11, which includes external control means.

Referring to FIG. 12, there is illustrated a fluid metering system constructed in accordance with an embodiment of the subject invention and designated generally by reference numeral 300. Fuel metering system 300 is substantially similar to fuel metering system 200 in that it includes a split discharge vane pump 10 with primary and secondary discharge arc pairs, as described above, a regulator valve 310, a bypass valve 320 and a check valve 330, all in fluid communication with each other in a similar manner.

Fluid metering system 300 differs from fluid metering system 200 in that it includes an external controller 340 for controlling the pressure differential across the regulator valve 310. It is envisioned that the external controller 340 could take the form of a dual channel torque motor or an electro-hydraulic servo valve (EHSV) or a similar device known in the art. The external controller 340 would be in communication with and receive commands from a Full-Authority Digital Controller (FADEC).

While the subject invention has been shown and described with reference to preferred embodiments, those skilled in the art will readily appreciate that various changes and/or modifications may be made thereto without departing from the spirit and/or scope of the subject disclosure.

What is claimed is:

1. A split discharge vane pump, comprising:

a) a pump body including an interior pumping chamber having a central axis and defining a continuous peripheral cam surface, the cam surface including four quadrantal cam segments, wherein diametrically opposed cam segments have identical cam profiles, and each cam segment defines an inlet arc, a discharge arc and two seal arcs;

b) a rotor mounted for axial rotation within the pumping chamber; and c) a plurality of circumferentially spaced apart radially extending vanes mounted for radial movement within the rotor, the plurality of vanes defining an equal number of circumferentially spaced apart volume chambers which extend between an outer periphery of the rotor and the cam surface for carrying pressurized fluid.

2. A split discharge vane pump as recited in claim 1, wherein a seal arc separates the inlet arc and discharge arc in each cam segment.

3. A split discharge vane pump as recited in claim 1, wherein a seal arc separates the inlet arc in one segment from the discharge are in a circumferentially adjacent segment.

4. A split discharge vane pump as recited in claim 1, wherein the discharge arcs of diametrically opposed cam segments are equally sized.

5. A split discharge vane pump as recited in claim 1, wherein the discharge arcs of circumferentially adjacent cam segments are not equally sized.

6. A split discharge vane pump as recited in claim 1, wherein there are sixteen circumferentially spaced apart radially extending vanes and an equal number of circumferentially spaced apart volume chambers.

7. A split discharge vane pump as recited in claim 1, wherein the pump housing includes inlet port means communicating with the inlet arc of each cam segment and outlet port means communicating with the discharge arc of each cam segment.

8. A split discharge vane pump as recited in claim 1, wherein the rotor includes a plurality of circumferentially spaced apart radially extending vane slots for accommodating the plurality of vanes.

9. A split discharge vane pump as recited in claim 8, further comprising laterally opposed side plates for enclosing the pumping chamber of the pump housing.

10. A split discharge vane pump as recited in claim 9, wherein each vane slot has an undervane pocket for receiving pressurized fluid based on an angular position of the rotor.

11. A split discharge vane pump as recited in claim 10, wherein each side plate includes means for feeding fluid into the undervane pocket of each vane slot based on an angular position of the rotor.

12. A split discharge vane pump as recited in claim 10, wherein the pressurized fluid in the rotor undervane whilst in the inlet arc segment is relatively low pressure fluid associated with an inlet arc of a cam segment, and is equal to pump inlet pressure.

13. A split discharge vane pump as recited in claim 10, wherein the pressurized fluid in the rotor undervane whilst in the discharge arc segment is relatively high pressure fluid associated with a discharge arc of a cam segment, and is equal to pump discharge pressure.

14. A split discharge vane pump as recited in claim 10, wherein the pressurized fluid in the rotor undervane whilst in a seal arc segment is relatively high pressure fluid associated with a discharge arc of a cam segment, and is equal to pump discharge pressure.

15. A split discharge vane pump as recited in claim 1, further comprising a fluid metering system for extracting fluid flow from the discharge arcs of the four cam segments.

16. A split discharge vane pump as recited in claim 15, wherein the fluid metering system has a first operating condition in which fluid is extracted from the discharge arcs of all four cam segments and combined for delivery to a source of fluid demand.

17. A split discharge vane pump as recited in claim 16, wherein the fluid metering system has a second operating condition wherein fluid is extracted from a first pair of diametrically opposed discharge arcs for delivery to a source of fluid demand and fluid from a second pair of diametrically opposed discharge arcs bypasses the source of fluid demand and returns to the pumping chamber.

* * * * *